US011008865B2

(12) United States Patent
Lindsey

(10) Patent No.: US 11,008,865 B2
(45) Date of Patent: May 18, 2021

(54) ROTARY PISTON AND CYLINDER DEVICES

(71) Applicant: LONTRA LIMITED, Southam (GB)

(72) Inventor: Stephen Francis Lindsey, Southam (GB)

(73) Assignee: LONTRA LIMITED, Southam (GB)

( * ) Notice: Subject to any disclaimer, the term of this patent is extended or adjusted under 35 U.S.C. 154(b) by 99 days.

(21) Appl. No.: 15/328,847

(22) PCT Filed: Jul. 24, 2015

(86) PCT No.: PCT/GB2015/052147
§ 371 (c)(1),
(2) Date: Jan. 24, 2017

(87) PCT Pub. No.: WO2016/012805
PCT Pub. Date: Jan. 28, 2016

(65) Prior Publication Data

US 2017/0204727 A1 Jul. 20, 2017

(30) Foreign Application Priority Data

Jul. 24, 2014 (GB) ..... 1413173

(51) Int. Cl.
*F03C 2/00* (2006.01)
*F03C 4/00* (2006.01)
(Continued)

(52) U.S. Cl.
CPC ..... *F01C 3/025* (2013.01); *F01C 3/02* (2013.01); *F04C 3/04* (2013.01); *F04C 2250/201* (2013.01)

(58) Field of Classification Search
CPC .... F01C 3/02; F01C 3/025; F04C 3/04; F04C 3/06; F04C 2250/20; F04C 2250/201
(Continued)

(56) References Cited

U.S. PATENT DOCUMENTS 6,250,900 B1 6/2001 Gostomski
2011/0174095 A1* 7/2011 Lindsey ..... F01C 3/02 74/63
(Continued)

FOREIGN PATENT DOCUMENTS

DE 15 53 050 12/1969
DE 195 09 913 9/1996
(Continued)

OTHER PUBLICATIONS

United Kingdom Search Report dated Feb. 23, 2015 in corresponding United Kingdom Application No. 1413172.6.
(Continued)

*Primary Examiner* — Theresa Trieu
(74) *Attorney, Agent, or Firm* — Whiteford, Taylor & Preston, LLP; Peter J. Davis

(57) ABSTRACT

In a rotary piston and cylinder device (1) having a stator and a rotor, in which the stator at least partially defines an annular cylinder space and the rotor includes at least one piston that extends from the rotor into the cylinder space, and in which, during use, the piston moves through the annular cylinder space on rotation of the rotor relative to the stator, wherein at least part of an outer surface (30) of the rotor (22) is a substantially frusto-conical shaped surface.

26 Claims, 6 Drawing Sheets

(51) Int. Cl.

| | |
|---|---|
| ***F04C 2/00*** | (2006.01) |
| ***F04C 18/00*** | (2006.01) |
| ***F01C 3/02*** | (2006.01) |
| ***F04C 3/04*** | (2006.01) |

(58) Field of Classification Search
USPC ..... 418/77, 195, 207; 123/221, 232, 233
See application file for complete search history.

(56) References Cited

U.S. PATENT DOCUMENTS

| | | | | |
|---|---|---|---|---|
| 2012/0034122 | A1* | 2/2012 | Hayes-Pankhurst ..... | F04C 5/00 418/45 |
| 2013/0202458 | A1 | 8/2013 | Byrne et al. | |

FOREIGN PATENT DOCUMENTS

| | | |
|---|---|---|
| EP | 0 933 500 | 8/1999 |
| GB | 1068067 | 7/1964 |
| WO | 91/14859 | 10/1991 |
| WO | 2007/093818 | 8/2007 |
| WO | 2010/023487 | 3/2010 |
| WO | 2010/122299 | 10/2010 |

OTHER PUBLICATIONS

International Search Report dated Oct. 26, 2015 in corresponding International Application No. PCT/GB2015/052150.
United Kingdom Search Report dated Feb. 20, 2015 in corresponding United Kingdom Application No. 1413173.4.
International Search Report dated Oct. 13, 2015 in corresponding International Application No. PCT/GB2015/052147.

* cited by examiner

ROTARY PISTON AND CYLINDER DEVICES

FIELD

The present invention relates generally to rotary piston and cylinder devices.

BACKGROUND

Rotary piston and cylinder devices can be configured for a variety of applications, such as an internal combustion engine, a fluid pump such as a supercharger, or as an expander such as a steam engine or turbine replacement.

A rotary piston and cylinder device comprises a rotor and a stator, the stator at least partially defining an annular cylinder space, the rotor may be in the form of a ring, and the rotor comprising at least one piston which extends from the rotor ring into the annular cylinder space, in use the at least one piston is moved circumferentially through the annular cylinder space on rotation of the rotor relative to the stator, the rotor body being sealed relative to the stator, and the device further comprising cylinder space shutter means which is capable of being moved relative to the stator to a closed position in which the shutter means partitions the annular cylinder space, and to an open position in which the shutter means permits passage of the at least one piston, the cylinder space shutter means comprising a shutter disc.

The term 'piston' is used herein in its widest sense to include, where the context admits, a partition capable of moving relative to a cylinder wall, and such partition need not generally be of substantial thickness in the direction of relative movement but can often be in the form of a blade. The partition may be of substantial thickness or may be hollow. The shutter disc may present a partition which extends substantially radially of the annular cylinder space.

Although in theory the shutter means could be reciprocable, it is preferred to avoid the use of reciprocating components, particularly when high speeds are required, and the shutter means is preferably at least one rotary shutter disc provided with at least one aperture which in the open condition of the shutter means is arranged to be positioned substantially in register with the circumferentially-extending bore of the annular cylinder space to permit passage of the at least one piston through the shutter disc.

We have devised an improved rotor.

The geometry of the surface interacting with the disc of the rotor for a rotary cylinder device is governed by the curved outer face of the rotating shutter disc that forms the end face of the cylinder, and allows the piston (blade) to pass through an aperture in the shutter disc at the end of a stroke. Depending on the specific configuration this shape can vary, but is in any event substantially curved. A solution apparent to one skilled in the art would therefore be for the outer face of the rotor to be substantially similar and curved with respect to the inner face, resulting in a substantially constant wall thickness, as shown by the rotor in FIG. 1, which has an axis of rotation A-A. The rotor is of substantially convex form, and may be viewed as a dished ring, which an aperture provided at the apex thereof. Such a solution decreases inertia of the rotor, and minimises the volume of working fluid contained in the outlet port, an example of which is described below and shown in FIG. 3. This port volume is the volume that can be taken up by the working fluid within the outlet port of the rotor, through which it passes from the cylinder to the outlet of the device, contained in the stator. Once the rotor passes the outlet aperture on the stator at the end of the stroke, any working fluid within the volume of the port is carried past the disc to the start of the cycle. This fluid represents both a loss in volumetric efficiency of the device, and a decrease in pumping efficiency in most configurations of the device, as the power used to do work on the fluid is wasted since it re-enters the cylinder while the inlet port is still open.

We have realised that it is significantly simpler to manufacture and inspect the accuracy of a conical surface as it does not require the use of user-implemented gauges, and significantly decreases the duration of digital inspection.

SUMMARY

According to an aspect of the invention, there is provided a rotor of a rotary piston and cylinder device wherein at least part of an outer surface of the rotor is a substantially frusto-conical shaped surface.

By frusto-conical surface we include the meaning of the shape of the surface of a truncated cone.

By 'outer surface' we mean a surface which is an opposite surface to that surface of the rotor which defines (in part) the cylinder space.

Preferably the outer face of the rotor is not curved, but instead is formed of at least one substantially conical element.

Preferably there is provided an annular cylinder space, and the rotor is provided with the piston forming the end face of the cylinder space, and a housing portion which extends away from the annular cylinder space, at an (axially) distal end of the rotor (i.e. at an end portion of the rotor along the axis of rotation of the rotor) which is substantially co-axial with the axis of rotation of the rotor, and the housing portion is rotationally connected to a transmission assembly to transmit rotation from the rotor to a rotatable shutter of the device, and the transmission assembly is at least partially enclosed by the housing portion.

The at least one aperture of the shutter disc may be provided substantially radially in the shutter disc.

Preferably the axis of rotation of the rotor is not parallel to the axis of rotation of the shutter disc. Most preferably the axis of rotation of the rotor is substantially orthogonal to the axis of rotation of the shutter disc.

Preferably the piston is so shaped that it will pass through an aperture in the moving shutter means, without balking, as the aperture passes through the annular cylinder space. The piston is preferably shaped so that there is minimal clearance between the piston and the aperture in the shutter means, such that a seal is formed as the piston passes through the aperture. A seal is preferably provided on a leading or trailing surface or edge of the piston. In the case of a compressor a seal could be provided on a leading surface and in the case of an expander a seal could be provided on a trailing surface. The term seal is used to include an arrangement which reduces clearance, minimising leakage, but not necessarily preventing fluid transfer across the seal.

The rotor body is preferably rotatably supported by the stator rather than relying on co-operation between the piston and the cylinder walls to relatively position the rotor body and stator. It will be appreciated that a rotary piston and cylinder device is distinct from a conventional reciprocating piston device in which the piston is maintained coaxial with the cylinder by suitable piston rings which give rise to relatively high friction forces.

The rotor is preferably rotatably supported by suitable bearing means carried by the stator.

Preferably the stator comprises at least one inlet port and at least one outlet port.

Preferably at least one of the ports is substantially adjacent to the shutter means.

Preferably the ratio of the angular velocity of the rotor to the angular velocity of the shutter disc is 1:1, although other ratios are possible.

The rotor may comprise one or more features described in the detailed description below and/or shown in the drawings.

BRIEF DESCRIPTION OF THE DRAWINGS

Various embodiments of the invention will now be described, by way of example only, with reference to the following drawings in which.

DETAILED DESCRIPTION

Figure 2:
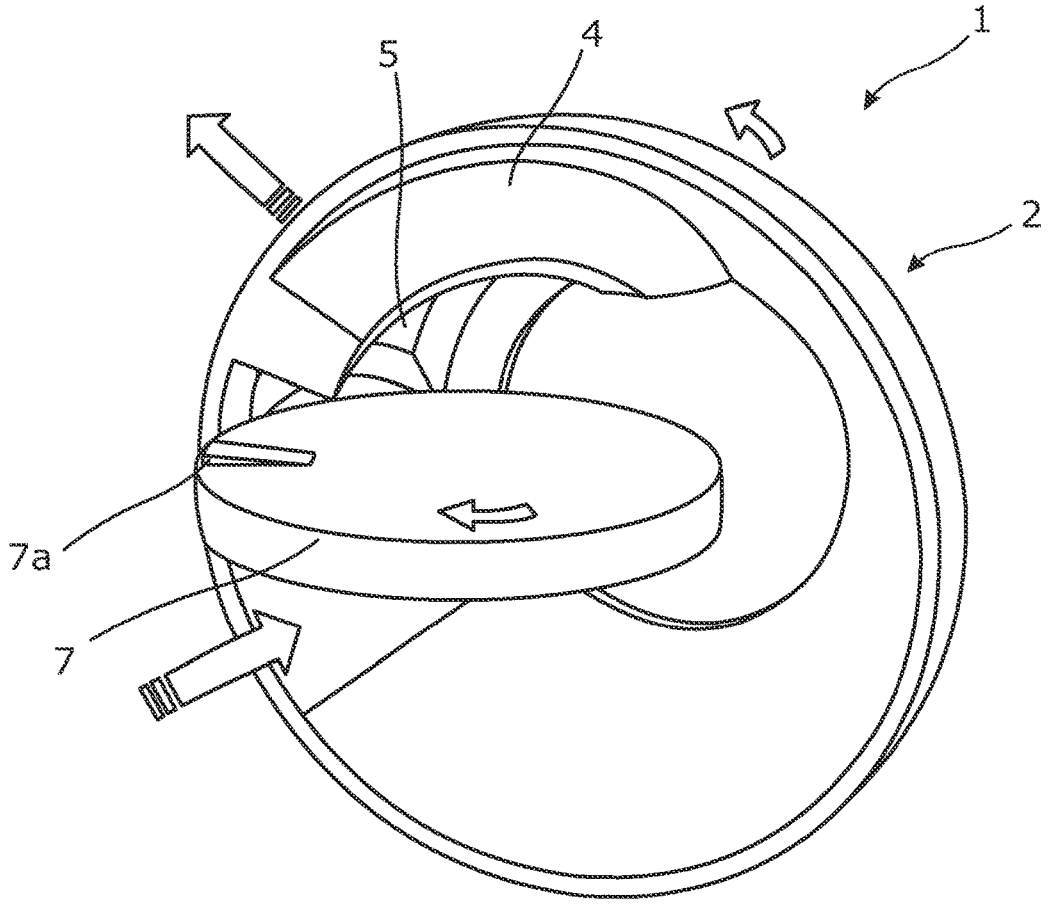
FIG. 2 is a perspective view of a rotary piston and cylinder device.
Figure 3:
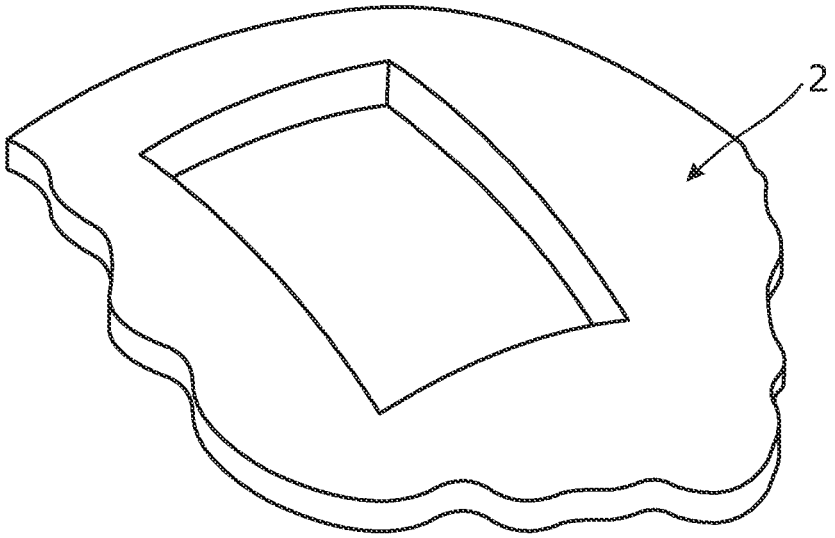
FIG. 3 is a perspective view of a port of a rotor.

Reference is made initially to FIG. 2 which shows a rotary piston and cylinder device 1 which comprises a rotor 2, a piston blade 4 which is secured to an inner surface of the rotor, a fluid port 5 formed in the rotor, a rotatable shutter disc 7, which is formed with an aperture 7*a*. It will be appreciated the device 1 also comprises a stator, not illustrated, which receives the rotor and the shutter disc, and, together with the inner surface of the rotor, defines the (annular) cylinder space. It should further be noted that the representation of the rotor is simplified for clarity.

Figure 4:
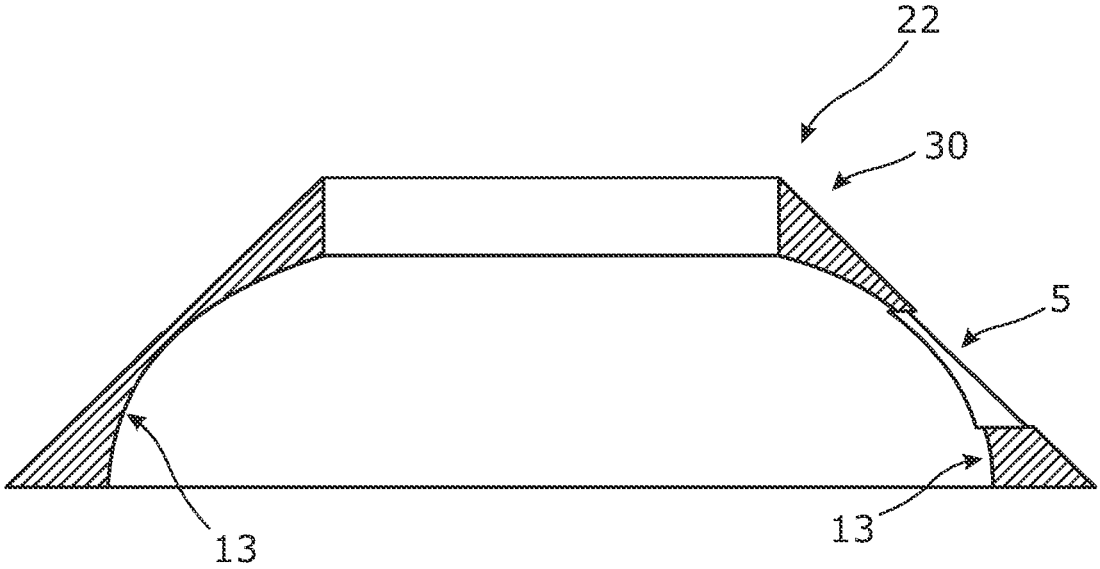
FIG. 4 is a cross-sectional view of a rotor.

FIG. 4 shows a first embodiment of a rotor where a curved (around the axis of rotation) outer surface of the rotor comprises a single substantially frusto-conical outer rotor surface 30, which surface constitutes the majority of the surface area of said outer surface. The surface 30 is configured to reduce the port volume and serves to increase stiffness of the rotor at its root due to the large thickness of material in that region. The rotor 22 also comprises an inner surface 13.

Figure 1:
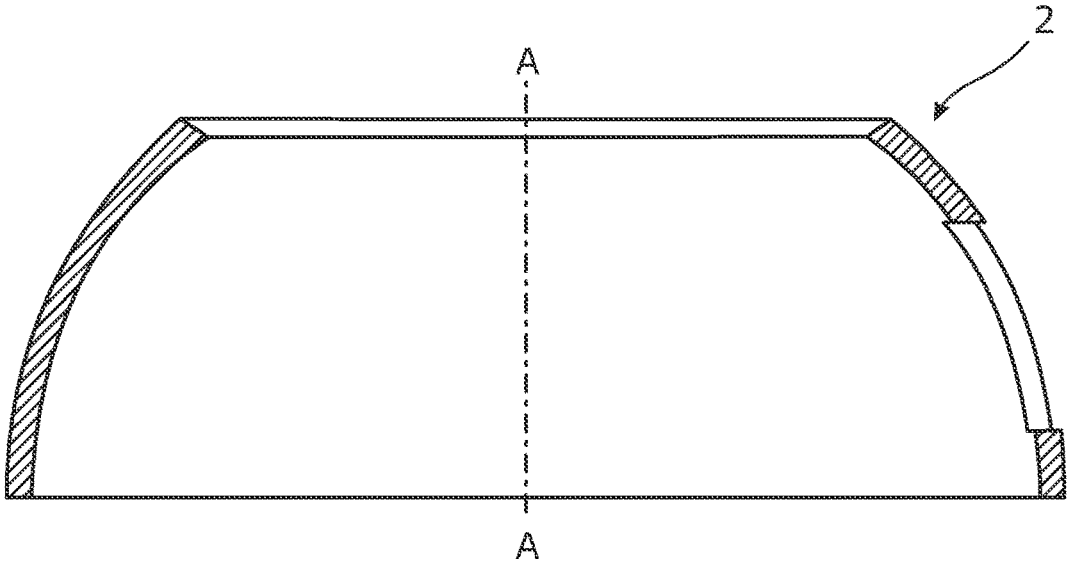
FIG. 1 is a cross-sectional view of rotor.
Figure 5:
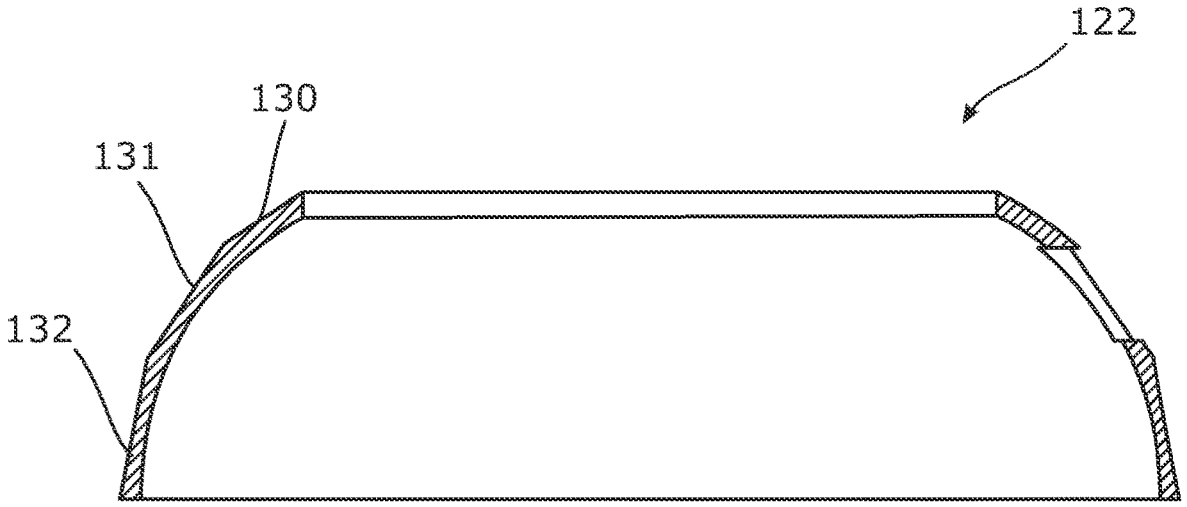
FIG. 5 is a cross-sectional view of a rotor.

FIG. 5 shows a second rotor embodiment, referenced 122, in which an outer rotor face comprises three adjacent (smaller) substantially frusto-conical surfaces, 130, 131 and 132. Each of the surfaces 130, 131 and 132 circumnavigates the rotor. This arrangement advantageously reduces the mass and inertia of the rotor compared to that shown in FIG. 1, which then allows for faster running speeds of the device, while still providing largely conical faces to obtain the benefits improved manufacturing accuracy and ease of inspection. It will be of course be understood that in other embodiments other numbers of conical faces may alternatively be included on the outer face.

Figure 6:
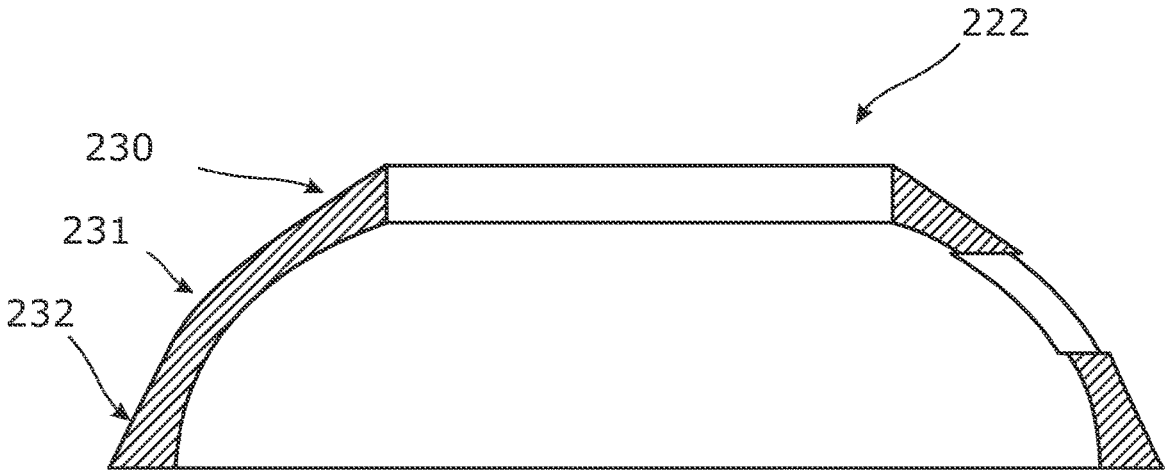
FIG. 6 is a cross-sectional view of a rotor.

FIG. 6 shows a further embodiment comprising a rotor 222, in which the outer surface comprises three identifiable portions, 230, 231 and 232. A central segment 231 is substantially curved (in cross-section) and is formed from at least one radius. The curvature of the central segment 231 preferably substantially corresponds to that of the inner surface of the rotor. Adjacent to, and flanking the surface 231, there are provided frusto-conical surfaces 230 and 232. Each has a respective (and different) cone angle. Although the inclusion of the curved surface 231 may reduce the certainty in the manufacturing accuracy of that face, the volume of the exhaust port is reduced for a given strength of the rotor. This serves to improve volumetric efficiency of the device, and would be the desirable embodiment for certain operational conditions.

In a further embodiment, the outer surface of the rotor comprises a frusto-conical portion and a curved portion, which occupy a major portion of the surface area of the outer surface of the rotor. In this embodiment, the frusto-conical portion is adjacent to the curved portion.

Figure 7:
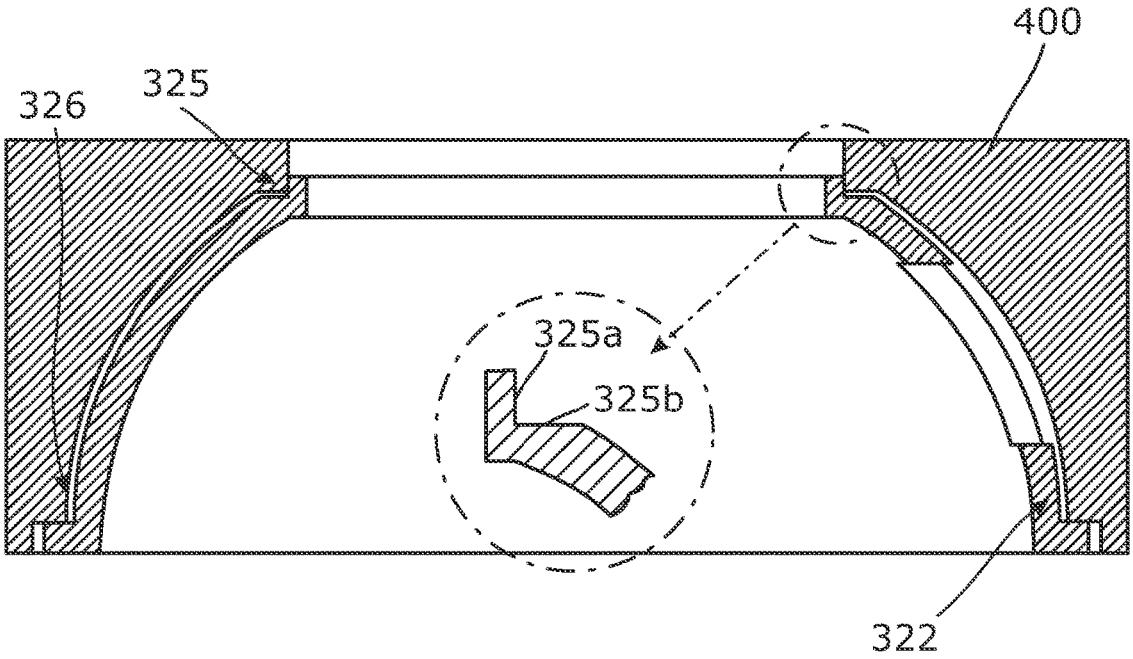
FIG. 7 is a cross-sectional view of a rotor mounted in a stator.

FIG. 7 shows a further embodiment comprising a rotor 322 and a stator 400, in which outer surface portions are arranged as shoulders 325 and 326 to thereby improve sealing performance. Each of the shoulders is located at distal end regions of the rotor, and in particular, adjacent to a respective circumscribed end, at a base region and at an apex region, those regions being spaced with respect to the axis if rotation of the rotor. The shoulders each comprise two surface portions on the outer surface of the rotor which are orientated substantially orthogonal to each other, as best seen by surfaces 325*a* and 325*b* in the exploded sub-view in FIG. 7. One of the surfaces may be substantially cylindrical, and the other may be planar. An annular planar surface may be thought of as a frusto-conical surface with a ninety degree cone angle, and a cylindrical surface can be thought of as a frusto-conical surface with a zero degree cone angle. It is possible for both faces of each shoulder to be close-running to provide sealing with the stator, but preferably only one of the faces of each shoulder is used as the sealing face with the stator, the choice depending on the characteristics of the rotor during operation.

For example, where the axial expansion of the rotor (i.e. expansion substantially in the direction of the rotational axis of the rotor) during service at the location of a particular shoulder is more significant than the radial expansion, the preferred sealing face is the one that is more substantially cylindrical, as the sealing gap will be less adversely affected by deformation of the rotor. Conversely if the radial expansion is more significant than the axial, sealing on the substantially planar face is preferred, as that gap will experience lower variation during operation of the device. It will be understood that both of these conditions can be experienced in different locations on a single rotor.

Figure 8:
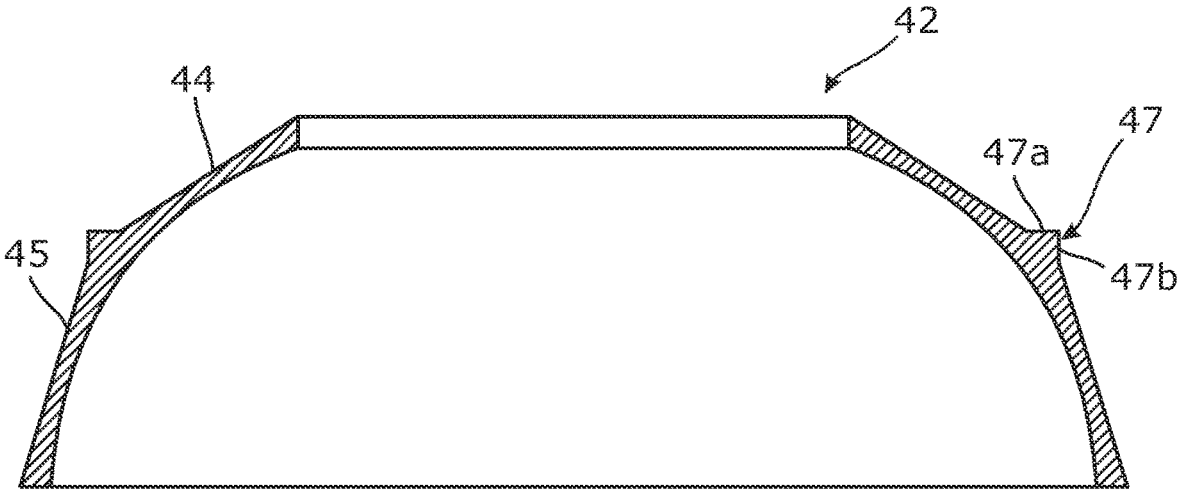
FIG. 8 is a cross-sectional view of a rotor.

FIG. 8 shows a further embodiment comprising a rotor 42 which comprises a first frusto-conical surface 44 and a second frusto-conical surface 45. Intermediate of the two frusto-conical surfaces there is provided a facet or shoulder 47 which protrudes generally outwardly of the rotor. The shoulder 47 extends around the rotor, and comprises two surfaces 47*a* and 47*b*, which are substantially orthogonal to each other. One or other or both of the surfaces is arranged to seal with an inner surface of a stator (not illustrated). This provides an alternative arrangement to that shown in FIG. 7 in which the shoulders are axially spaced from each other. In an alternative embodiment, the shoulder is replaced by an (annular) recess which is received by a complimentary formation on the inner surface of the stator. Shoulders of this type also add stiffness to the rotor.

If the behaviour of the rotor during operation is well understood such that the location-dependant relative effects of thermal, centrifugal and pressure-related deformation on the rotor as well as any displacements are known, the preferred angle of a substantially conical sealing region (between the rotor and the stator) in any of the above examples can be calculated. Put otherwise, the cone angle can to tailored according to operational conditions. In one embodiment, a particular angle of the substantially conical face will minimise variation of the sealing gap at a particular position during operation of the device. Furthermore, the angle can be set to selectively vary the gap (between the rotor and the stator) during operation, such as to either prioritise frequent running conditions by minimising the sealing gap (i.e. reducing the size of the gap as compared to when the device is stationary) at those operating points, or reduce input power for transient conditions such as start-up by increasing the sealing gap under these scenarios.

Figure 11:
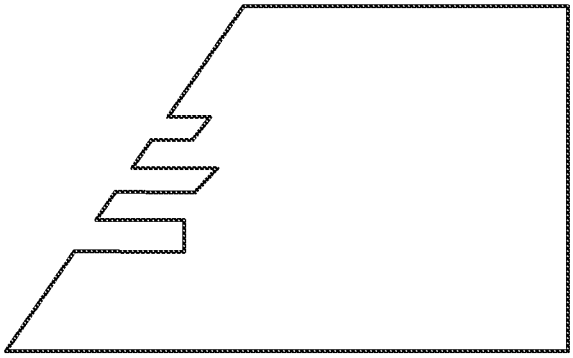
FIGS. 9 to 11 show differently shaped grooves provided on a frusto-conical outer surface of a rotor.
Figure 10:
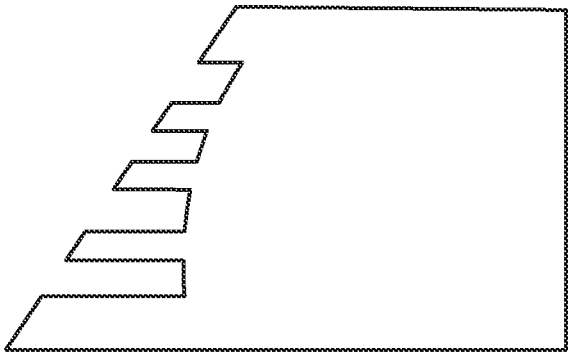
Figure 9:
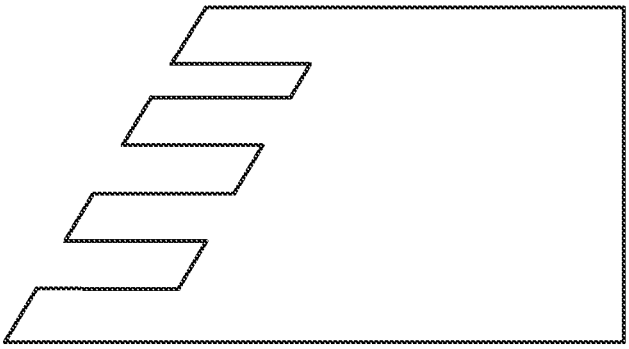

FIG. 9 to FIG. 11 show a further embodiment, where a series of grooves are cut into one of the frusto-conical surfaces of the rotor to further improve sealing. The grooves can be a plurality of circumferential groves, or be a single helical groove, so as to thereby form a labyrinth-type structure. The grooves can be of a range of possible cross-sections (including rectangular, triangular, skewed rectangular, for example) to improve sealing for a particular application.

It is to be noted that it is the substantially outer faces of the ridges (which define the grooves) that are more significant for sealing purposes, and that the substantially inner surfaces of the grooves can conform to a plurality of different sections, including conical, curved or irregular. Although it is possible to cut grooves into a geometry which provides a constant operational gap width and obtain the benefits of improved axial leakage sealing performance with a controlled and substantially constant sealing gap, it may be preferred to instead orient the face to maximise relative motion along the normal direction. Here the deformation of the rotor at the location of the face is largely radial during operation, and less than the clearance between the labyrinth outer face and mating stator face. In this manner it is possible to control the sealing gap at different operating conditions, to either target specific operating conditions or reduce power consumption during transient conditions.

In a further possible variant, the maximum deformation of the rotor at a particular point is greater than the static clearance between it and the stator, and a material that can be worn away by the ridges is applied to the mating face. The material is an abradable coating applied to the stator face (or alternatively which may be applied to the rotor conical surface, with ridge formations on the stator), and the labyrinth structure is formed of a series of circumferential grooves on the outer rotor face. The rotor may be assembled so that the sealing faces are clear of each other or such that they are touching (and then rotated to abrade on clearance). During operation, the substantially outward radial deformation of the rotor (towards the stator) causes the ridges to cut into the abradable coating on the mating stationary sealing face of the stator. This results in a sealing interface in which the gap is minimised during operation as shown in FIG. 12, and greater when the device is subsequently stopped, as shown in FIG. 13.

Figure 12:
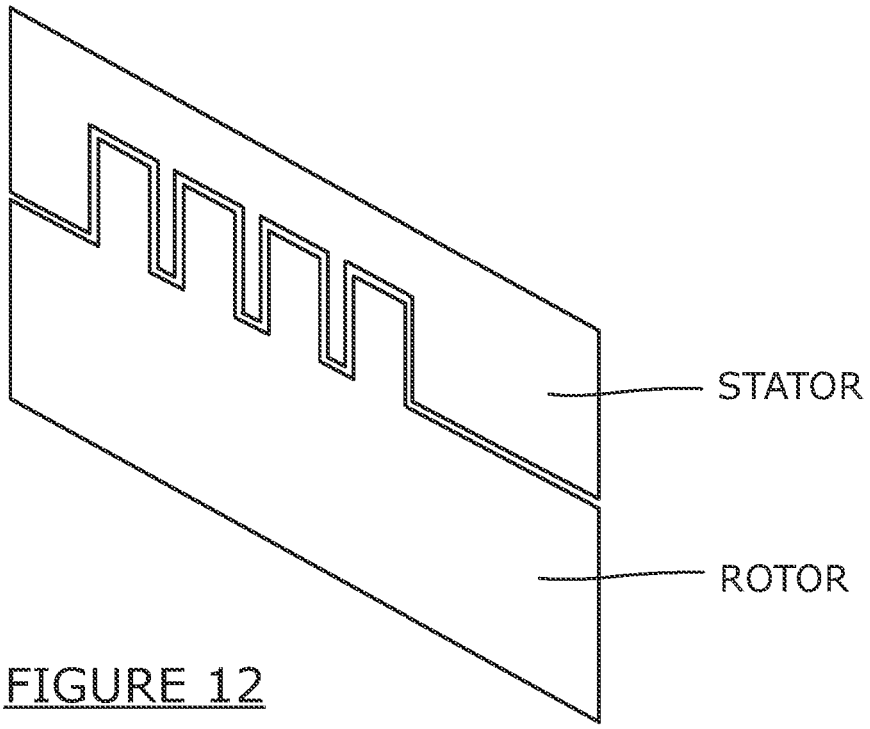
FIGS. 12 and 13 show mateable stator and rotor surfaces.
Figure 13:
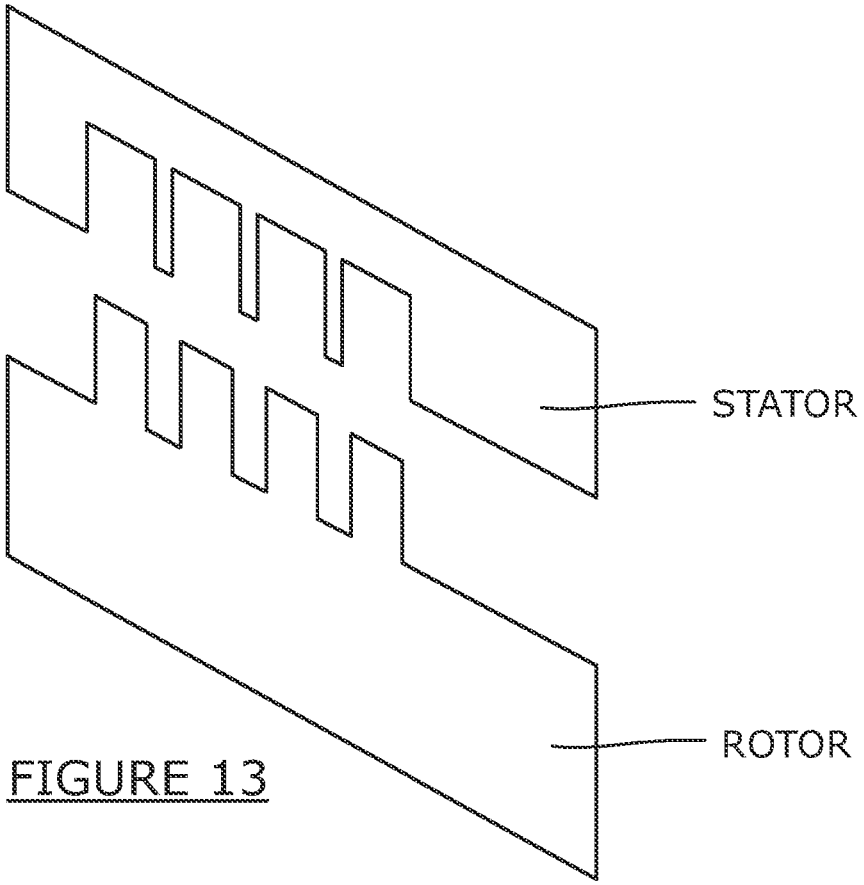

It will be noted that it is also possible to assemble the device while the rotor is being rotated, such that the grooves wear away the abradable material during assembly, immediately resulting in a geometry similar to that shown FIG. 12. Such an assembly method can be used if the considered mating faces on the rotor and stator are designed to have a largely constant gap width during operation, in order for the labyrinth structure to always be engaged with the inverse geometry of the abradable coating.

In a further variant, it is possible to create a mating inverse labyrinth geometry on the stator using a material that will not be worn by the groves on the rotor. While this approach reduces uncertainty in wear patterns of the abradable, it will be understood that the deformation of the rotor must be minimised in order to achieve low gap widths throughout the labyrinth during operation, without allowing the mating faces to touch.

The invention claimed is:

1. A rotor for a rotary piston and cylinder device, the device comprising a rotor and a stator, the stator and the rotor defining an annular cylinder space, the rotor comprising at least one piston which extends from the rotor into the cylinder space, and in use the piston is moved through the annular cylinder space on rotation of the rotor relative to the stator, and the device comprising a rotatable shutter disc which is arranged to be moved to a closed position in which the shutter disc partitions the cylinder space and an open condition in which shutter disc allows passage of the at least one piston, wherein at least part of an outer surface of the rotor is a generally frusto-conical shaped surface, and said frusto-conical shaped surface is opposite a surface of the rotor which in part defines the annular cylinder space.

2. The rotor as claimed in claim 1 in which the frusto-conical shaped surface extends for part of the height of the rotor in a direction along a rotational axis of the rotor.

3. The rotor as claimed in claim 1 in which a plurality of generally frusto-conical shaped surfaces are provided.

4. The rotor as claimed in claim 3 in which each frusto-conical shaped surface has a different respective cone angle.

5. The rotor as claimed in claim 3, in which at least two of the frusto-conical shaped surfaces are spaced-apart in a direction along a rotational axis of the rotor by an intermediate curved surface, which is curved in cross-section.

6. The rotor as claimed in claim 5 in which the intermediate curved surface is provided with a fluid port.

7. The rotor as claimed in claim 5 in which the curved surface is generally central of the height of the rotor.

8. The rotor as claimed in claim 5 in which a single generally frusto-conical shaped surface is located to each side of a generally central curved surface.

9. The rotor as claimed in claim 3 in which at least two of the frusto-conical shaped surfaces are adjacent to each other.

10. The rotor as claimed in claim 3 in which a major surface area of the outer surface of the rotor comprises three frusto-conical surface portions.

11. The rotor as claimed in claim 1 in which a majority of the outer surface of the rotor is frusto-conical.

12. The rotor as claimed in claim 11 in which the majority of the outer surface comprises a single frusto-conical surface.

13. The rotor as claimed in claim 1 in which the outer surface consists essentially of a curved portion and a generally frusto-conical portion.

14. The rotor as claimed in claim 1, which comprises at least one shoulder arranged to seal with a stator, and a sealing surface of the shoulder is provided on the outer surface of the rotor.

15. The rotor as claimed in claim 14 in which only one of two faces forming the shoulder is used as the operative sealing face, in use.

16. The rotor as claimed in claim 14 in which a shoulder is provided at each distal end region of the rotor, spaced along an axis of rotation of the rotor.

17. The rotor as claimed in claim 14, wherein the at least one shoulder comprises a frusto-conical face, and a cylindrical face.

18. The rotor as claimed in claim 14, where at least one set of shoulders is located each side of a region in which a fluid port is located.

19. The rotor as claimed in claim 1 in which a fluid port is provided in the frusto-conical shaped surface.

20. The rotor as claimed in claim 1, where a series of grooves are provided in the frusto-conical shaped surface.

21. The rotor as claimed in claim 20, in which the frusto-conical shaped surface which is provided with the grooves is arranged such that relative motion in a normal direction between the rotor and mating stator surface is minimised to achieve a constant gap width during operation.

22. The rotor as claimed in claim 20, in which the frusto-conical shaped surface containing the groves is aligned such that at a time during or after assembly, a displacement or deformation of the rotor causes the grooves to cut into an abradable coating on an opposing sealing face of a stator, or of the rotor where the grooves are provided on the stator and an abradable coating is provided on the rotor.

23. The rotor as described in claim 1, wherein a cone angle of the generally frusto-conical shaped surface is selected to create a desired gap between opposing faces of the rotor and the stator at particular operating conditions, or during a range of conditions.

24. The rotor as claimed in claim 1 in which an inner surface of the rotor, which at least in part defines an annular cylinder space, comprises a curved surface.

25. The rotor as claimed in claim 1 having an inner surface which is of generally concave shape.

26. The rotor as claimed in claim 1 in which the rotor comprises a dished ring.

* * * * *